US010900308B2

(12) United States Patent
Sim et al.

(10) Patent No.: US 10,900,308 B2
(45) Date of Patent: Jan. 26, 2021

(54) VISCOUS DAMPING SYSTEMS FOR HYDROSTATICALLY SET DOWNHOLE TOOLS

(71) Applicant: Halliburton Energy Services, Inc., Houston, TX (US)

(72) Inventors: Nicholas Kok Jun Sim, Singapore (SG); Iris Sok Yee Kam, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/514,842

(22) Filed: Jul. 17, 2019

(65) Prior Publication Data

US 2019/0338608 A1 Nov. 7, 2019

Related U.S. Application Data

(63) Continuation of application No. 14/904,709, filed as application No. PCT/US2015/033001 on May 28, 2015, now Pat. No. 10,400,534.

(51) Int. Cl.
*E21B 23/04* (2006.01)
*E21B 23/06* (2006.01)
*E21B 33/128* (2006.01)

(52) U.S. Cl.
CPC ..... *E21B 23/04* (2013.01); *E21B 23/06* (2013.01); *E21B 33/128* (2013.01)

(58) Field of Classification Search
CPC ..... E21B 23/04; E21B 23/06; E21B 33/128
See application file for complete search history.

(56) References Cited

U.S. PATENT DOCUMENTS

| | | | | |
|---|---|---|---|---|
| 3,520,360 | A | 7/1970 | Kisling | |
| 4,817,739 | A | 4/1989 | Jeter | |
| 5,029,642 | A | 7/1991 | Crawford | |
| 5,103,906 | A | 4/1992 | Schultz et al. | |
| 5,119,875 | A | 6/1992 | Richard | |
| 5,277,253 | A * | 1/1994 | Giroux | E21B 33/127 166/187 |
| 6,779,600 | B2 | 8/2004 | King et al. | |
| 7,562,712 | B2 | 7/2009 | Cho | |
| 8,322,450 | B2 | 12/2012 | Meijer | |
| 9,206,669 | B2 | 12/2015 | Holderman | |
| 9,725,976 | B2 | 8/2017 | Loginov | |
| 2005/0236162 | A1 | 10/2005 | Badrak et al. | |
| 2008/0283238 | A1 | 11/2008 | Richards | |

(Continued)

OTHER PUBLICATIONS

International Search Report and Written Opinion for PCT/US2015/033001 dated Dec. 22, 2015.

*Primary Examiner* — James G Sayre
(74) *Attorney, Agent, or Firm* — McGuireWoods LLP

(57) ABSTRACT

A system for activating a downhole tool may include a mandrel, a first piston disposed about the mandrel and defining a piston chamber therebetween, a flow restrictor positioned in the piston chamber and separating the piston chamber into an upper chamber located uphole of the flow restrictor and a lower chamber located downhole of the flow restrictor, and a second piston disposed in the upper chamber. The flow restrictor may define at least one orifice extending axially therethrough and, a damping fluid may reside in the piston chamber downhole from the second piston.

12 Claims, 7 Drawing Sheets

(56) References Cited

U.S. PATENT DOCUMENTS

| | | | |
|---|---|---|---|
| 2009/0126936 | A1 | 5/2009 | Begley |
| 2010/0032177 | A1 | 2/2010 | Tuomas |
| 2010/0244340 | A1 | 9/2010 | Wootten |
| 2013/0092399 | A1 | 4/2013 | Giroux et al. |
| 2013/0180731 | A1 | 7/2013 | Acosta et al. |
| 2013/0233572 | A1 | 9/2013 | Helms et al. |
| 2014/0048263 | A1 | 2/2014 | Acosta |
| 2014/0048281 | A1 | 2/2014 | Acosta et al. |
| 2014/0076535 | A1 | 3/2014 | Doane |
| 2014/0083713 | A1 | 3/2014 | Budler |
| 2014/0166298 | A1 | 6/2014 | Fenwick |
| 2014/0231096 | A1 | 8/2014 | Eddison |
| 2015/0292296 | A1 | 10/2015 | Ezell |

* cited by examiner

VISCOUS DAMPING SYSTEMS FOR HYDROSTATICALLY SET DOWNHOLE TOOLS

CROSS-REFERENCE TO RELATED APPLICATIONS

This application is a continuation of U.S. patent application Ser. No. 14/904,709 filed on Jan. 13, 2016 entitled "Viscous Damping Systems for Hydrostatically Set Downhole Tools", which claims the benefit of International PCT Application no. PCT/US2015/033001, filed May 28, 2015 both of which are incorporated herein by reference.

BACKGROUND

As the depth of wellbores increase, the hydrostatic set pressure required to set downhole tools, such as packers, also increases and results in a very high setting force needed to activate the downhole tools. For instance, when a rupture disk used in a downhole tool is expended, a constant piston force acts on an associated hydrostatic cylinder which results in constant acceleration and increasing velocity in setting the downhole tool. The hydrostatic cylinder may have a high kinetic energy stored therein and this can cause considerable damage to stationary components located uphole when the hydrostatic cylinder impacts such stationary components. For instance, the high velocity impact may damage the sealing elements and a back-up system, if used, and may ultimately result in failure of the downhole tool.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

The present disclosure is related to downhole tools used in the oil and gas industry and, more particularly, to preventing uncontrollable axial movement of actuation components of a downhole tool. More specifically, the embodiments described herein prevent uncontrolled axial motion of a hydrostatic piston as it traverses over a mandrel of a downhole tool. The controlled linear motion may permit packers and/or other types of downhole tools to have a higher hydrostatic setting pressure with greater speed control and may reduce damage to the downhole tools.

Figure 1:
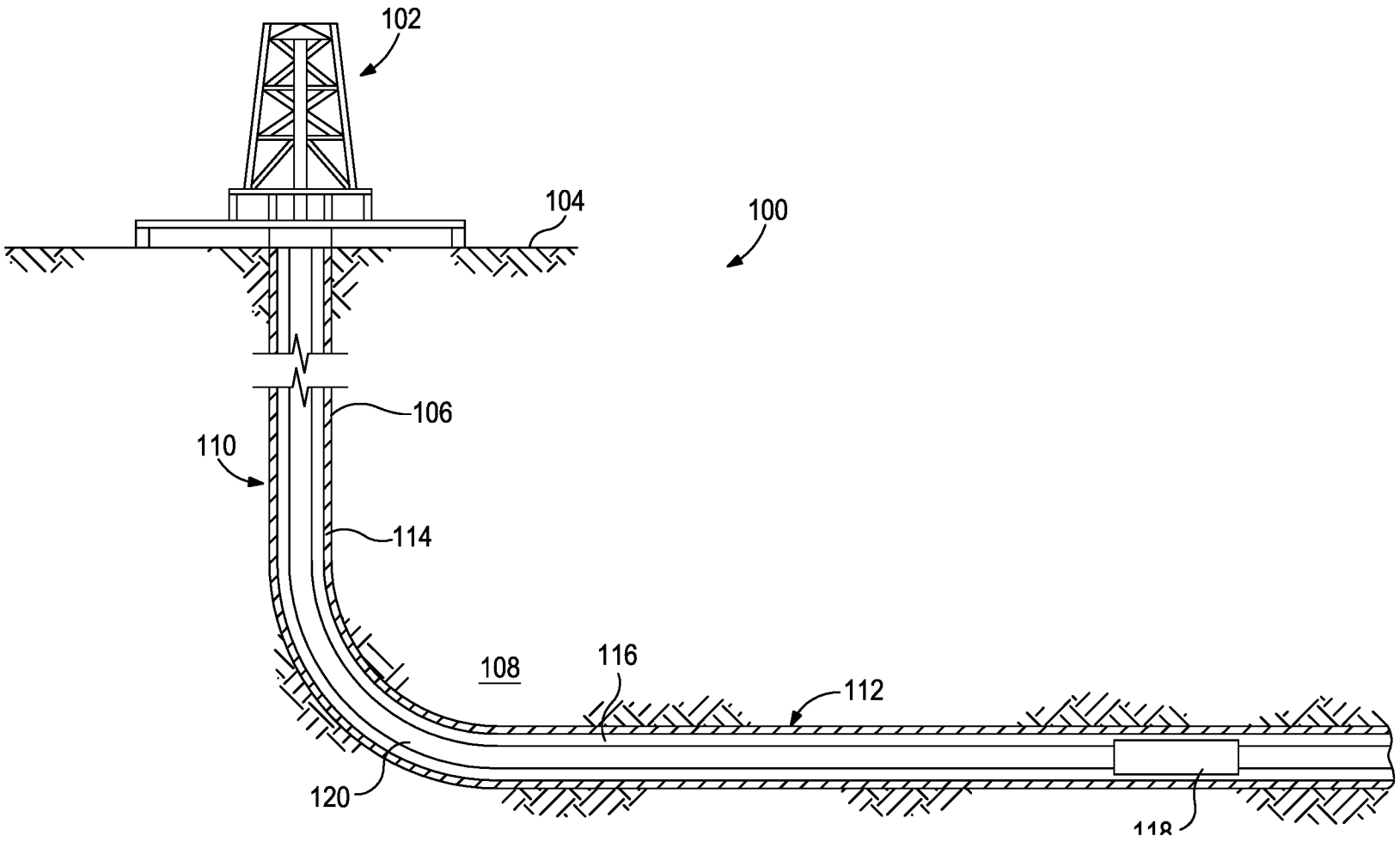
FIG. 1 illustrates an exemplary well system that may embody or otherwise employ one or more principles of the present disclosure.

FIG. 1 illustrates an exemplary well system 100 that may embody or otherwise employ one or more principles of the present disclosure, according to one or more embodiments. As illustrated, the well system 100 may include a service rig 102 that is positioned on the earth's surface 104 and extends over and around a wellbore 106 that penetrates a subterranean formation 108. The service rig 102 may be a drilling rig, a completion rig, a workover rig, or the like. In some embodiments, the service rig 102 may be omitted and replaced with a standard surface wellhead completion or installation. Moreover, while the well system 100 is depicted as a land-based operation, it will be appreciated that the principles of the present disclosure could equally be applied in any sea-based or sub-sea application where the service rig 102 may be a floating platform or sub-surface wellhead installation, as generally known in the art.

The wellbore 106 may be drilled into the subterranean formation 108 using any suitable drilling technique and may extend in a substantially vertical direction away from the earth's surface 104 over a vertical wellbore portion 110. At some point in the wellbore 106, the vertical wellbore portion 110 may deviate from vertical relative to the earth's surface 104 and transition into a substantially horizontal wellbore portion 112. In some embodiments, the wellbore 106 may be at least partially lined with a wellbore tubing 114. The wellbore tubing 114 may refer to any downhole tubing or string of tubulars known to those skilled in the art including, but not limited to, casing, wellbore liner, production tubing, drill string, gravel pack strings or inserts, or other downhole piping systems.

The wellbore tubing 114 contains a work string 120 that extends downward therethrough from the service rig 102. A downhole tool 118 may be disposed on the work string 120. The downhole tool 118 may include, for instance, a packer that may be moveable between set and unset positions, as is known in the art, by the application of axial force in order to force slips and/or seals radially outwardly and into engagement with the walls of the wellbore tubing 114. The work string 120 may be, but is not limited to, production tubing, drill string, wellbore tubing, coiled tubing, wireline, slickline, or any other wellbore conveyance known to those skilled in the art. An annulus 116 may be defined between the production string 120 and the wellbore tubing 114.

Even though FIG. 1 depicts the downhole tool 118 as being arranged and operating in the horizontal portion 112 of the wellbore 106, the embodiments described herein are equally applicable for use in portions of the wellbore 106 that are vertical, deviated, or otherwise slanted. Moreover, use of directional terms such as above, below, upper, lower, upward, downward, uphole, downhole, and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well. As used herein, the term "proximal" refers to that portion of the component being referred to that is closest to the wellhead, and the term "distal" refers to the portion of the component that is furthest from the wellhead.

Figure 2:
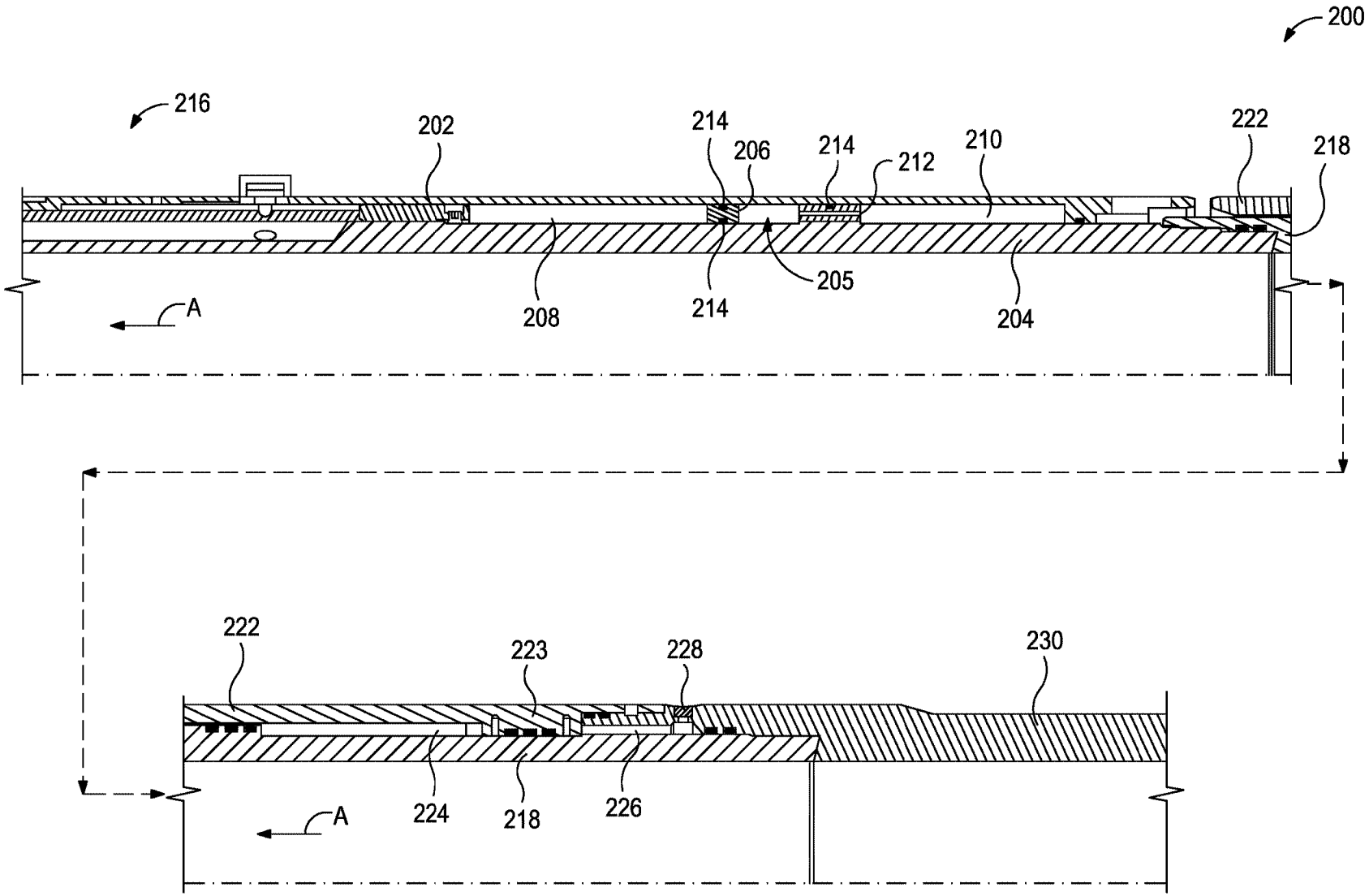
FIG. 2 illustrates progressive cross-sectional views of an activation system.

FIG. 2 illustrates a progressive cross-sectional view of an activation system 200, according to one or more embodiments. In one or more embodiments, the activation system 200 may be used to move a downhole tool 216 from an unset position to a set position. As illustrated, the activation system 200 may include an upper piston 202 mounted on an upper mandrel 204 and radially spaced therefrom. The upper piston 202 may be configured to move axially with respect to the upper mandrel 204 and a piston chamber 205 may be defined between the upper piston 202 and the upper mandrel 204. A floating piston 206 may be movably disposed within the piston chamber 205 and may sealingly engage opposing inner and outer walls of the upper piston 202 and the upper mandrel 204, respectively. The floating piston 206 may be configured to move axially with respect to the upper piston 202 and the upper mandrel 204.

The activation system 200 may further include a flow restrictor 212 positioned within the piston chamber 205. The flow restrictor 212 may be annular in shape and may be fixed to the outer circumferential surface of the upper mandrel 204 such that the upper piston 202 may move relative to the flow restrictor 212. Alternatively, the flow restrictor 212 may be fixed to the inner circumferential surface of the upper piston 202 such that the upper piston 202 and the flow restrictor 212 may move relative to the upper mandrel 204. In at least one embodiment, the flow restrictor 212 may be characterized as a retainer seal or choke for the activation system 200. The flow restrictor 212 may separate the piston chamber 205 into an upper chamber 208 and a lower chamber 210. As illustrated, the floating piston 206 may be positioned in the upper chamber 208.

As disclosed in detail below, the floating piston 206 may separate the upper chamber 208 such that a wellbore fluid resides in the piston chamber 205 uphole from the floating piston 206, and a damping fluid resides in the piston chamber 205 downhole from the floating piston 206. The damping fluid may exhibit a known viscosity. In operation of the activation system 200, the floating piston 206 may prove advantageous in preventing the wellbore fluid from intermingling with and otherwise contaminating the damping fluid. To accomplish this, the floating piston 206 may include one or more inner and outer sealing elements 214 (one of each shown) configured to provide a seal such that fluids (e.g., hydraulic fluids, wellbore fluids, gases, etc.) are unable to migrate in either axial direction past the floating piston 206.

The flow restrictor 212 may also include one or more sealing elements 214 (one shown) configured to seal an interface between the upper piston 202 and the flow restrictor 212 as the upper piston 202 moves axially with respect to the upper piston 202 and the flow restrictor 212. In some embodiments, one or more of the sealing elements 214 may be O-rings or another type of dynamic sealing element. In other embodiments, one or more of the sealing elements 214 may be another type or design of elastomeric sealing element known to those skilled in the art.

The downhole tool 216 is illustrated as generally being located axially uphole of the upper piston 202. The downhole tool 216 may be the same as or similar to the downhole tool 118 of FIG. 1 and, therefore, may be used in conjunction with the well system 100 of FIG. 1. The downhole tool 216 may be set or otherwise activated by the upper piston 202 when the upper piston 202 moves axially uphole (i.e., to the left in FIG. 2). In some embodiments, the downhole tool 216 may be a well packer. In other embodiments, however, the downhole tool 216 may be a casing annulus isolation tool, a stage cementing tool, a multistage tool, formation packer shoes or collars, combinations thereof, or any other downhole tool. In one or more embodiments, the downhole tool 216 may include a standard compression-set element that expands radially outward when subjected to compression. Alternatively, the downhole tool 216 may include compressible slips on a swellable element, a compression-set element that partially collapses, a ramped element, a cup-type element, a chevron-type seal, one or more inflatable elements, an epoxy or gel introduced into the annulus 116 (FIG. 1), combinations thereof, or other sealing elements.

Still referring to FIG. 2, a lower mandrel 218 may be coupled to the upper mandrel 204 at a downhole end of the upper mandrel 204, and a downhole end of the lower mandrel 218 may be coupled to a bottom sub 230. For instance, the lower mandrel 218 may be coupled to the upper mandrel 204 and the bottom sub 230 via a threaded connection or any other suitable coupling mechanism. A lower piston 222 may be disposed about the lower mandrel 218. A hydraulic chamber 224 and a rupture cavity 226 may be defined between the lower piston 222 and the lower mandrel 218. The hydraulic chamber 224 and the rupture cavity 226 may be prevented from fluid communication with each other via a sealing ring 223 that extends radially inward from an inner circumferential surface of the lower piston 222. In some embodiments, the sealing ring 223 may be an elastomeric sealing element known to those skilled in the art that may prevent fluid communication between the hydraulic chamber 224 and the rupture cavity 226.

A rupture member 228 may be positioned on the lower piston 222 and may prevent fluid communication between the rupture cavity 226 and the annulus 116 (FIG. 1) defined in the wellbore 106 (FIG. 1). The rupture member 228 may be configured to rupture and otherwise fail when subjected to a predetermined threshold pressure differential. When the rupture member 228 is ruptured, the rupture cavity 226 may be exposed to the wellbore pressure and the wellbore pressure may be able to enter and build within the rupture cavity 226. Since the hydraulic chamber 224 is at or near atmospheric pressure, the pressure buildup in the rupture cavity 226 may move the lower piston 222 axially in the uphole direction (indicated by the arrow A) and contact the upper piston 202. The upper piston 202 may receive the axial load provided by the lower piston 222 and correspondingly move in the uphole direction, thereby causing the downhole tool 216 to activate.

The rupture member 228 may comprise or otherwise include, among other things, a burst disk, an elastomeric seal, a metal seal, a plate having an area of reduced cross section, a pivoting member held in a closed position by shear pins designed to fail in response to a predetermined shear load, an engineered component having built-in stress risers of a particular configuration, and/or substantially any other component that is specifically designed to rupture or fail in a controlled manner when subjected to a predetermined threshold pressure differential. The rupture member 228 may function substantially as a seal between isolated chambers (e.g., the annulus 116 and the rupture cavity 226) only until a pressure differential between the isolated chambers reaches the predetermined threshold value, at which point the rupture member fails, bursts, or otherwise opens to allow fluid to flow from the chamber at higher pressure into the chamber at lower pressure. The specific size, type, and configuration of the rupture member 228 may generally be chosen so the rupture member 228 may rupture at a desired pressure differential. The desired pressure differential may be associated with the desired depth at which the downhole tool 216 is to be set.

Figure 3:
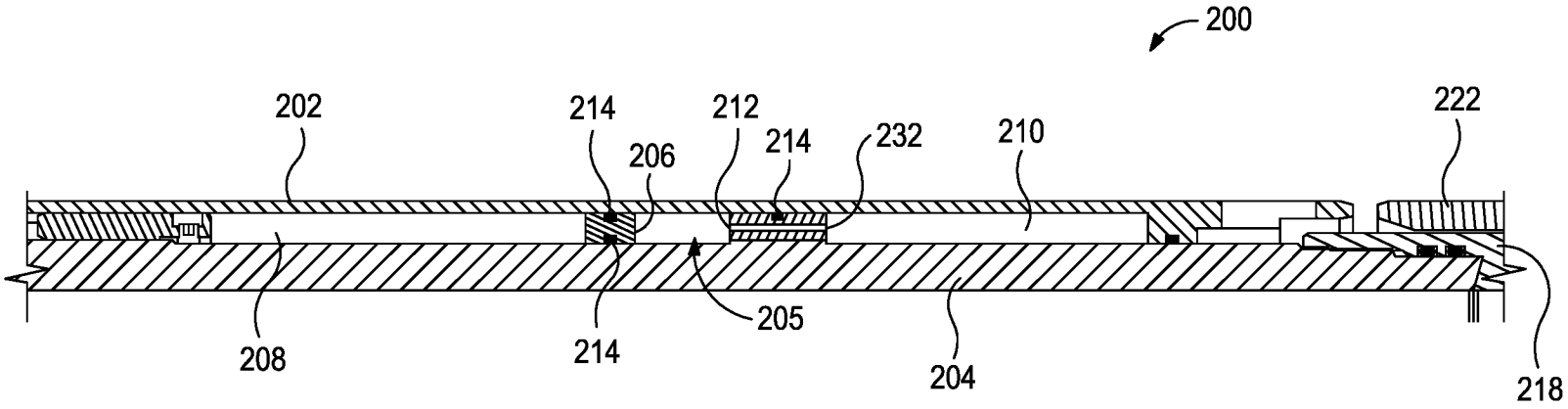
FIG. 3 illustrates an expanded view of a portion of FIG. 2.

FIG. 3 illustrates an enlarged cross-sectional view of a portion of FIG. 2. As illustrated, the flow restrictor 212 may provide and otherwise define one or more choke orifices 232 (one shown) that provide fluid communication between the lower chamber 210 and the portion of the upper chamber 208 downhole from the floating piston 206. As indicated above, the lower chamber 210 and portion of the upper chamber 208 downhole from the floating piston 206 may include a damping fluid that exhibits a known viscosity. The flow restrictor 212 may thus be immersed in the damping fluid. When the upper piston 202 moves in the uphole direction, the volume of the lower chamber 210 correspondingly decreases. As a result, the damping fluid may be forced to traverse and otherwise flow across the flow restrictor 212 via the choke orifice(s) 232.

The choke orifice(s) 232 may be sized and otherwise configured to choke the flow of the damping fluid across the flow restrictor 212 from the lower chamber 210 to the portion of the upper chamber 208 downhole from the floating piston 206, thereby decreasing the velocity of the upper piston 202. As will be appreciated, this may result in a controlled axial movement of the upper piston 202 and may prevent damage of the various seals in the activation system 200 and/or the downhole tool 216. Moreover, knowing the viscosity of the damping fluid and the specific dimensions (i.e., orifice diameter, conduit length, etc.) of the choke orifice(s) 232 may allow an operator to control the velocity of the damping fluid traversing through the choke orifice(s) 232 to selectively optimize movement of the upper piston 202 and, therefore, move the downhole tool 216 from the unset to the set positions in a known manner. In another embodiment, the choke orifice(s) 232 may define a torturous flow path for the damping fluid to traverse. In yet another embodiment, a check valve may be disposed in the choke orifice(s) 232 to control the transient pressure built up in the system. It should be noted that the damping fluid and/or the flow restrictor 212 may not alter the force required to activate or set the downhole tool 216, but may prevent uncontrollable acceleration of the upper piston 202.

FIG. 3 shows an initial or before stroke position of the upper piston 202. Herein, the upper piston 202 has not yet moved axially due to contact by the lower piston 222, for instance, due to rupture of the rupture member 228.

Figure 4:
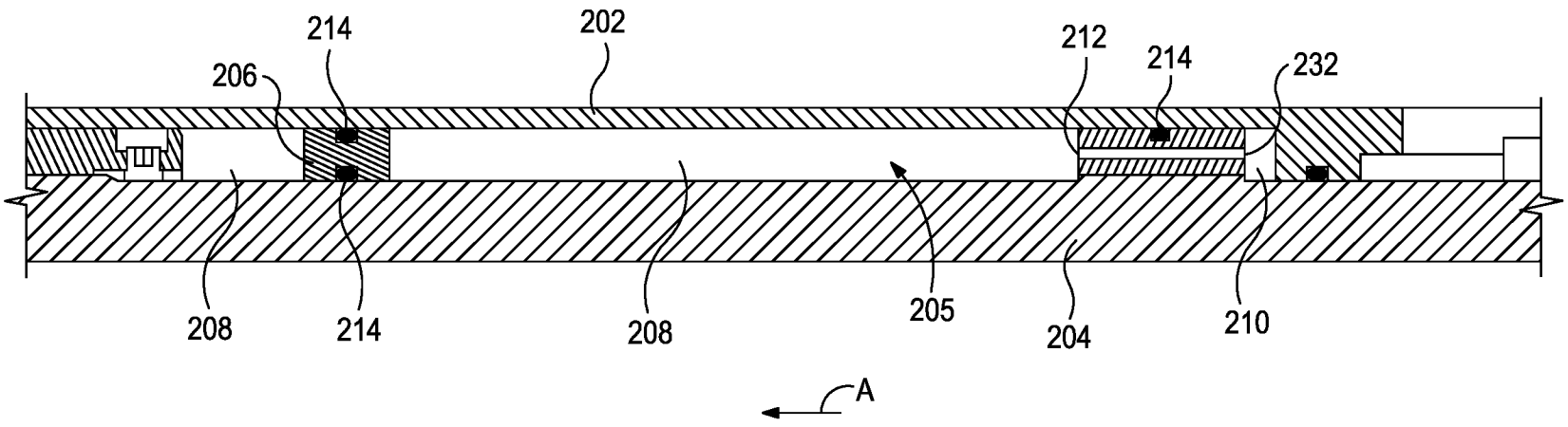
FIG. 4 illustrates an after stroke position of the upper piston.

FIG. 4 illustrates an after stroke position, wherein it may be seen that the upper piston 202 has moved axially in the direction of arrow A. The floating piston 206 is also shown to have moved in the direction of arrow A due to the motion of the damping fluid in the lower chamber 210. The portion of the upper chamber 208 uphole from the floating piston 206 may be at wellbore pressure and axial movement of the floating piston 206 may prevent build-up of differential pressure, thereby maintaining a constant pressure differential across components of the downhole tool 216 during run-in.

Figure 5:
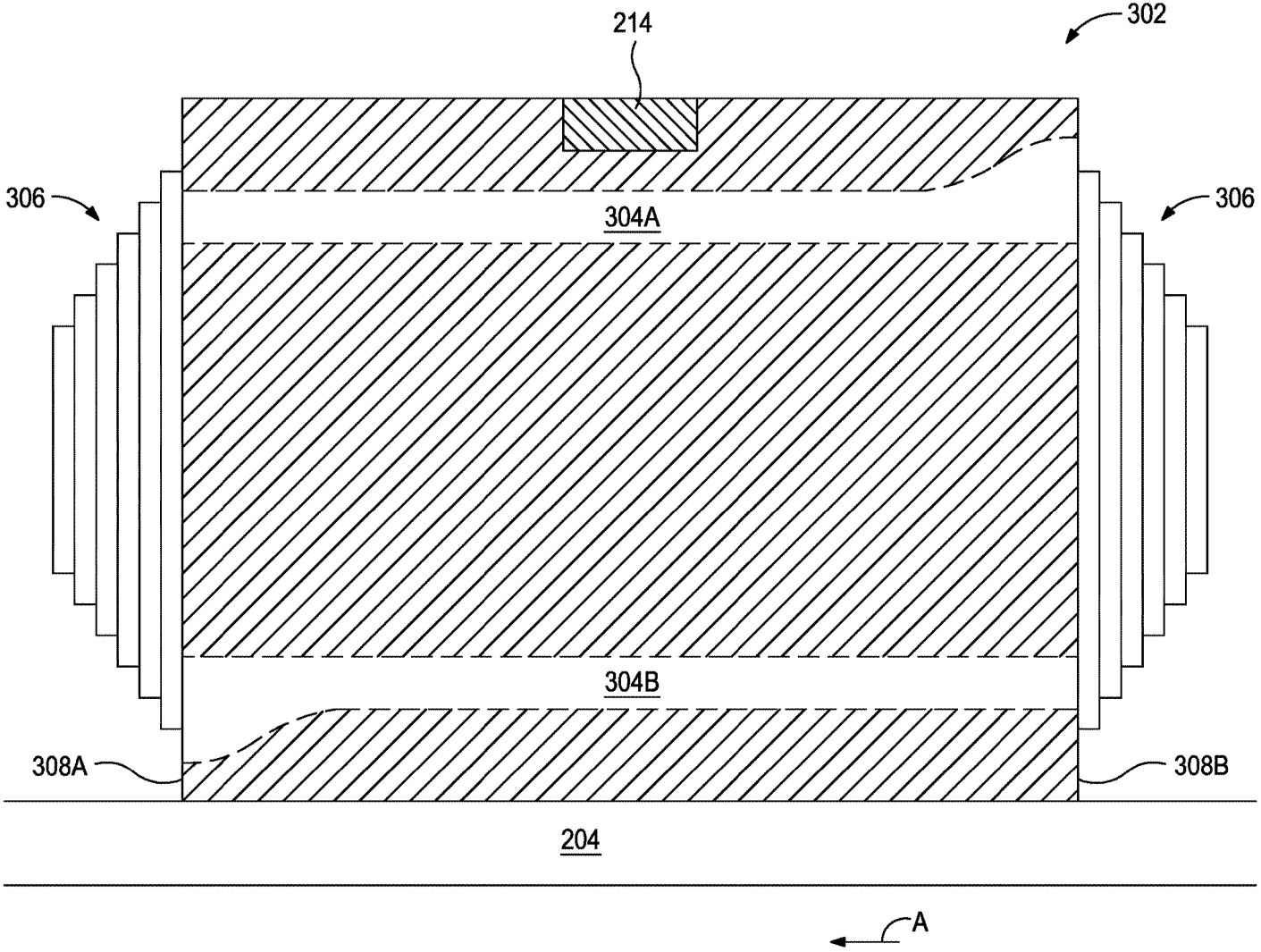
FIG. 5 illustrates an exemplary flow restrictor.

Referring now to FIG. 5, illustrated is a cross-sectional side view of an exemplary flow restrictor 302, according to one or more embodiments disclosed. The flow restrictor 302 may be similar in some respects to the flow restrictor 212 of FIGS. 2-4, and therefore may be best understood with reference thereto where like numerals designate like components not described again in detail. In one or more embodiments, the flow restrictor 302 may define a first orifice 304A and a second orifice 304B axially extending through the flow restrictor 302 between the opposite axial end surfaces 308A, 308B of the flow restrictor 302. As illustrated, each first and second orifices 304A, 304B may define an opening at one axial end that is larger the opening at the opposing axial end. The first orifice 304A, for example, has a larger opening located on the lower axial end surface 308B of the flow restrictor 302 as opposed to the opening at the upper axial end surface 308A. Likewise, the second orifice 304B has a larger opening located on the upper axial end surface 308A of the flow restrictor 302 as opposed to the opening at the lower axial end surface 308B.

A plurality of flexible shims 306 (or, shim plates) may be arranged in a stacked configuration on each axial end surface 308A, 308B of the flow restrictor 302. In at least one embodiment, the stack of shims 306 may be pyramidal in shape with the larger diameter shims located at the bottom of the stack on the respective axial end surfaces 308A, 308B. Each stack of shims 306 may partially cover the axial openings of the first and second orifices 304A, 304B having the larger cross-sectional area and may completely cover the axial openings of the first and second orifices 304*a*, 304B having the smaller cross-sectional area. When the upper piston 202 moves in the direction of the arrow A (see also FIGS. 2 and 4), damping fluid may enter the second orifice 304B through the axial opening on the axial end surface 308A. The damping fluid may force one or more of the relatively larger diameter shims 306 on the second axial end surface 308B to curve away from the axial end surface 308B. As a result, the damping fluid may exit the second orifice 304B. As will be understood, damping fluid may not flow through the first orifice 304A since the shims 306 on the axial end surface 408A completely cover the axial opening of the first orifice 304A. An opposite action may be observed when the upper piston 202 moves in the opposite direction. In this case, damping fluid may flow through the first orifice 304A and one or more larger diameter shims 306 on the axial end surface 308A may curve away from the axial end surface 308A to create an opening for the damping fluid to exit the first orifice 304A. As will be understood, the damping fluid may not flow through the second orifice 304B. The plurality of shims 306 may provide additional control over the axial movement of the upper piston 202.

Similar to the embodiment above, the viscosity of the damping fluid and the specific dimensions (i.e., orifice diameter, conduit length, etc.) of the first and second orifices 304A, 304B may be varied and otherwise configured to choke the flow of the damping fluid across the flow restrictor 302 from the lower chamber 210 to the upper chamber 208, thereby decreasing the velocity of the upper piston 202. This may permit an operator to control the velocity of the damping fluid traversing through the first and second orifices 304A, 304B to selectively optimize movement of the upper piston 202 and, therefore, move the downhole tool 216 from the set to the unset positions in a known manner. In another embodiment, the first and second orifices 304A, 304B may define a torturous flow path for the damping fluid to traverse. In yet another embodiment, a check valve may be disposed in the first and second orifices 304A, 304B to control the transient pressure built up in the system.

Figure 6:
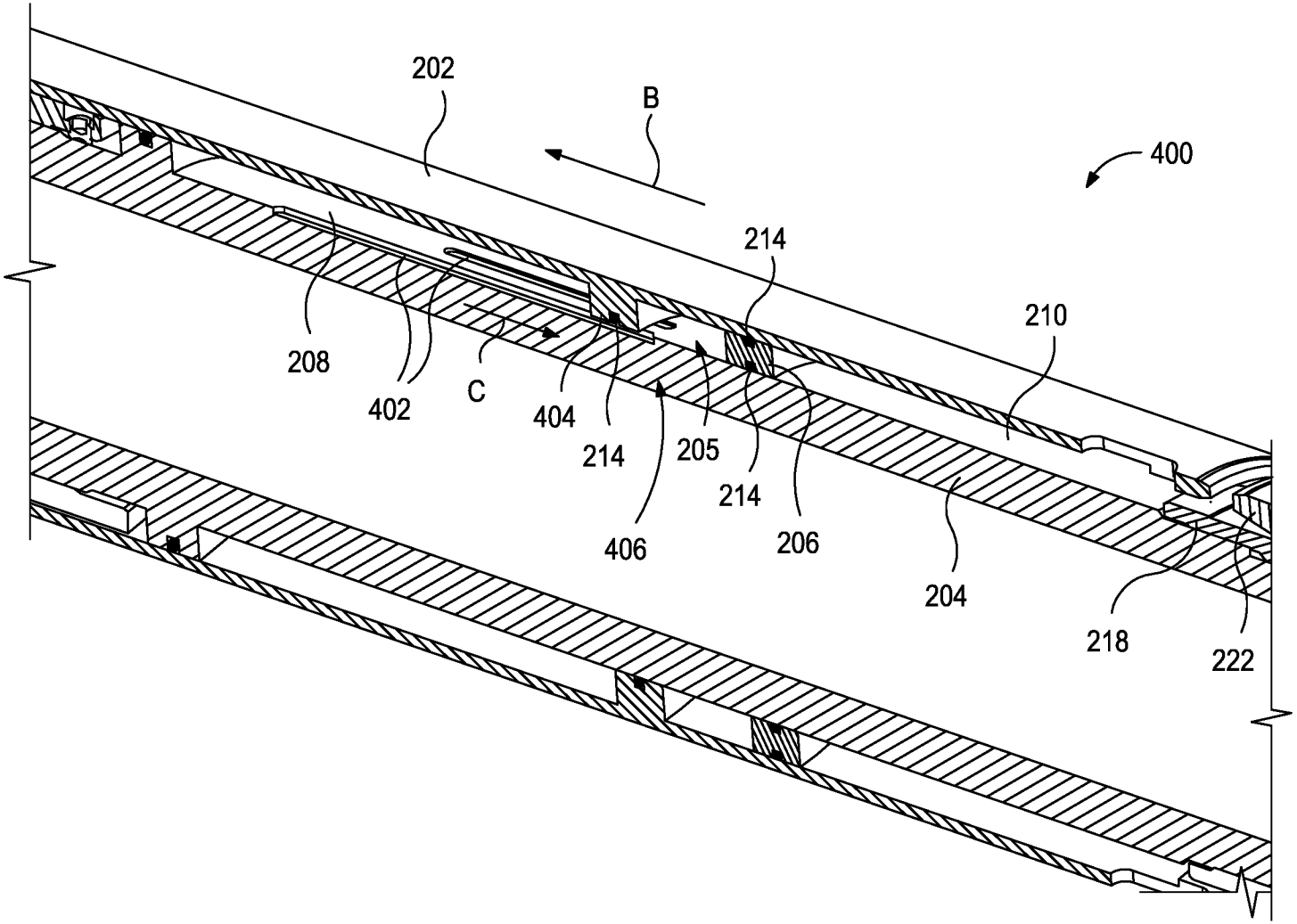
FIG. 6 illustrates an isometric view of the upper mandrel of FIG. 2 having longitudinal grooves of different axial lengths defined thereon, according to one or more embodiments.

FIG. 6 illustrates a cross-sectional isometric view of another exemplary activation system 400, according to one or more embodiments. The activation system 400 may be similar in some respects to the activation system 200 of FIGS. 2-4 and therefore may be best understood with reference thereto, where like numerals represent like elements not described again. Similar to the activation system 200, the activation system 400 may be used to move a downhole tool, such as the downhole tool 118 of FIG. 1 or 216 of FIG. 2, from an unset position to a set position. As illustrated, the upper mandrel 204 of the activation system 400 may define and otherwise provide at least two longitudinal grooves 402 in its outer radial surface that extend to different axial lengths. The grooves 402 may be angularly offset from each other about the circumference of the upper mandrel 204 and may each provide an axial end 406 located at the same axial location. It should be noted that, although only two grooves 402 are illustrated in FIG. 6, the number of grooves 402 is not limited to two, but instead may vary without departing from the scope of the disclosure.

The piston chamber 205 may again be defined between the upper piston 202 and the upper mandrel 204, and a sealing ring 404 may extend radially inward from an inner circumferential surface of the upper piston 202 and may otherwise divide the piston chamber 205 into the upper and lower chambers 208, 210. The floating piston 206 may be movably positioned within the lower chamber 210 and may separate a damping fluid residing in the upper chamber 208 and uphole from the floating piston 206 from wellbore fluids residing in the lower chamber 210 and downhole from the floating piston 206.

When the upper piston 202 moves axially, as described above, the sealing ring 404 may correspondingly move in the same direction and axially traverse portions of the grooves 402. The sealing ring 404 may be positioned such that, in an initial or pre-stroke position of the upper piston 202, the axial ends 406 of the grooves 402 may be located at least slightly downhole from the sealing ring 404. The sealing ring 404 may include one or more inner sealing elements 214 (one shown) configured to provide a seal such that the damping fluid may migrate across the sealing ring 404 in either axial direction only via the grooves 402. The floating piston 206 may also include one or more inner and outer sealing elements 214 (one of each shown) configured to provide a seal such that the damping and wellbore fluids are unable to migrate in either axial direction past the floating piston 206, whereby the wellbore fluid is prevented from intermingling with and otherwise contaminating the damping fluid.

During operation, the lower piston 222 contacts and urges the upper piston 202 in the direction indicated by the arrow B. As a result, the sealing ring 404 axially traverses the grooves 402 in the same direction and the damping fluid is forced in the opposite direction indicated by the arrow C via the grooves 402. Given the different lengths of the grooves 402, the amount of damping fluid that may be forced through the grooves 402 gradually decreases. For instance, initially all grooves 402 may be available for the damping fluid to migrate across the sealing ring 404. As the sealing ring 404 (and the upper piston 202) moves in the direction B, however, the sealing ring 404 may pass the opposing end of at least one of the grooves 402 and thereby reduce the flow rate potential for the damping fluid to migrate across the sealing ring 404. Reducing the flow rate potential correspondingly impedes the motion of the upper piston 202 such that the velocity of the upper piston 202 gradually decreases. As a result, the axial motion of the upper piston 202 may be controlled.

Figure 7:
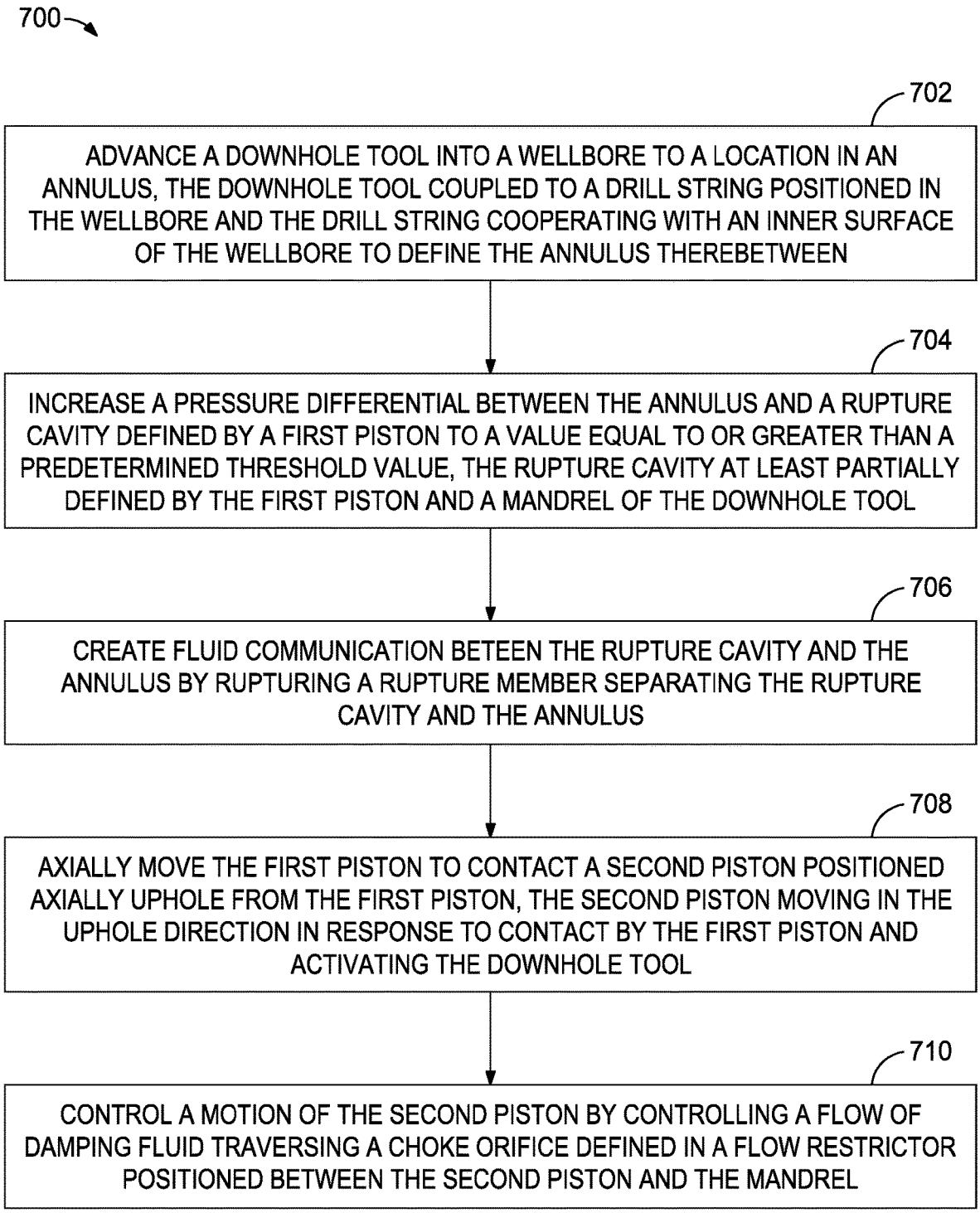
FIG. 7 illustrates a flowchart of operating an activation system, according to one or more embodiments disclosed.

FIG. 7 illustrates a flowchart of a method 700 of activating a downhole tool in a wellbore, according to one or more embodiments disclosed. The method includes advancing a downhole tool into a wellbore to a location in an annulus, as at 702, and increasing a pressure differential between the annulus and a rupture cavity defined by a first piston to a value equal to or greater than a predetermined threshold value, as at 704. The downhole tool may be coupled to a drill string positioned in the wellbore and the drill string may cooperate with an inner surface of the wellbore to define the annulus therebetween. The rupture cavity may at least be partially defined by the first piston and a mandrel of the downhole tool. The method may further include creating fluid communication between the rupture cavity and the annulus by rupturing a rupture member separating the rupture cavity and the annulus, as at 706, axially moving the first piston to contact a second piston positioned axially uphole from the first piston, as at 708, and controlling a motion of the second piston by controlling a flow of damping fluid traversing a choke orifice defined in a flow restrictor positioned between the second piston and the mandrel, as at 710. The second piston may move in the uphole direction in response to contact by the first piston and activate the downhole tool.

Embodiments disclosed herein include:

A. A system for activating a downhole tool that includes a mandrel, a first piston disposed about the mandrel and defining a piston chamber therebetween, a flow restrictor positioned in the piston chamber and separating the piston chamber into an upper chamber located uphole of the flow restrictor and a lower chamber located downhole of the flow restrictor, the flow restrictor defining at least one orifice extending axially therethrough, and a second piston disposed in the upper chamber, a damping fluid residing in the piston chamber downhole from the second piston.

B. A system for activating a downhole tool that includes a mandrel, at least two longitudinal grooves defined on an outer circumferential surface of the mandrel and extending to different axial lengths, a first piston mounted on the mandrel and defining a piston chamber therebetween, a sealing ring extending radially inward from the first piston and positioned on the at least two longitudinal grooves, the sealing ring separating the piston chamber into an upper chamber located uphole of the sealing ring and a lower chamber located downhole of the sealing ring, and a second piston disposed about the mandrel in the lower chamber, a damping fluid residing in the piston chamber uphole from the second piston.

C. A method that includes advancing a downhole tool into a wellbore to a location in an annulus, the downhole tool being coupled to a drill string positioned in the wellbore and the drill string cooperating with an inner surface of the wellbore to define the annulus therebetween, increasing a pressure differential between the annulus and a rupture cavity defined by a first piston to a value equal to or greater than a predetermined threshold value, the rupture cavity being at least partially defined by the first piston and a mandrel of the downhole tool, creating fluid communication between the rupture cavity and the annulus by rupturing a rupture member separating the rupture cavity and the annulus, axially moving the first piston to contact a second piston positioned axially uphole from the first piston, the second piston moving in the uphole direction in response to contact by the first piston and activating the downhole tool, and controlling a motion of the second piston by controlling a flow of damping fluid traversing a choke orifice defined in a flow restrictor positioned between the second piston and the mandrel.

Each of embodiments A, B, and C may have one or more of the following additional elements in any combination: Element 1: further comprising a third piston mounted on the mandrel downhole from the first piston, the third piston and the mandrel defining a hydraulic chamber and a rupture cavity therebetween. Element 2: further comprising a rupture member having a first side exposed to the rupture cavity and a second side exposed to a source of variable pressure, the rupture member configured to prevent fluid communication between the rupture cavity and the source of variable pressure when a pressure differential between the rupture cavity and the source of variable pressure is less than a predetermined threshold value. Element 3: wherein the source of variable pressure is an annulus of a wellbore. Element 4: wherein the system is coupled to a drill string and is moveable into the wellbore with the drill string, and, as the system is moved deeper into the wellbore, a hydrostatic pressure in the annulus increases, thereby increasing the pressure differential between the rupture cavity and the source of variable pressure. Element 5: wherein, when the pressure differential is greater than or equal to the predetermined value, the rupture member is configured to provide fluid communication between the source of variable pressure and the rupture cavity, and the third piston moves axially in the uphole direction and contacts the first piston. Element 6: wherein, upon contact, the first piston is configured to move axially in the uphole direction causing the damping fluid to flow across the flow restrictor via the at least one orifice, the at least one orifice restricting the flow of the damping fluid across the flow restrictor, whereby a velocity of the first piston is decreased. Element 7: wherein the first piston moves axially in the uphole direction and activates the downhole tool. Element 8: wherein the flow restrictor is secured against axial movement. Element 9: wherein the second piston axially moves in the upper chamber. Element 10: further comprising one or more sealing elements arranged about the second piston and the flow restrictor and configured to generate a hydraulic seal that prevents fluids from migrating in either axial direction past the second piston and that permits fluids to migrate across the flow restrictor only via the at least one orifice. Element 11: wherein the flow restrictor defines at least two orifices extending axially therethrough, and wherein a plurality of shims stacked on opposing axial surfaces of the flow restrictor and coupled thereto, the plurality of shims configured to selectively permit the damping fluid to flow through the at least two orifices.

Element 12: wherein, when the first piston moves axially along the mandrel, the sealing ring traverses at least a portion of an axial length of at least one of the at least two longitudinal grooves, whereby the damping fluid flows across the sealing ring via the at least one longitudinal groove. Element 13: wherein a velocity of the first piston decreases as the sealing ring traverses the at least one longitudinal groove. Element 14: further comprising a third piston mounted on the mandrel axially downhole from the first piston, the third piston and the mandrel defining a hydraulic chamber and a rupture cavity therebetween. Element 15: further comprising a rupture member having a first side exposed to the rupture cavity and a second side exposed to an annulus of a wellbore, the rupture member configured to prevent fluid communication between the rupture cavity and the annulus of the wellbore when a pressure differential between the rupture cavity and the annulus of the wellbore is less than a predetermined threshold value. Element 16: wherein, when the pressure differential is greater than or equal to the predetermined value, the rupture member is configured to provide fluid communication between the annulus of the wellbore and the rupture cavity, and the third piston moves axially in the uphole direction and contacts the first piston.

Element 17: further comprising controlling the flow of damping fluid traversing the choke orifice via a plurality of shims coupled to opposing axial sides of the flow restrictor.

By way of non-limiting example, exemplary combinations applicable to A, B, and C include: Element 1 with Element 2; Element 2 with Element 3; Element 3 with Element 4; Element 3 with Element 5; Element 5 with Element 6; Element 6 with Element 7; Element 12 with Element 13; Element 14 with Element 15; and Element 15 with Element 16.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

What is claimed is:

1. A system for activating a downhole tool, comprising:

a mandrel;

at least one longitudinal groove defined on an outer circumferential surface of the mandrel and extending axially;

a first piston mounted on the mandrel and defining a piston chamber therebetween;

a sealing ring extending radially inward from the first piston and positioned proximate the at least one longitudinal groove, the sealing ring separating the piston chamber into an upper chamber located uphole of the sealing ring and a lower chamber located downhole of the sealing ring;

a second piston disposed about the mandrel in the lower chamber; and a damping fluid residing in the piston chamber uphole from the second piston.

2. The system of claim 1, wherein, when the first piston moves axially along the mandrel, the sealing ring traverses at least a portion of an axial length of theat least one longitudinal groove, whereby the damping fluid flows across the sealing ring via the at least one longitudinal groove.

3. The system of claim 2, wherein a resistance force of the first piston increases as the sealing ring traverses the at least one longitudinal groove.

4. The system of claim 1, further comprising a third piston mounted on the mandrel axially downhole from the first piston, the third piston and the mandrel defining a hydrostatic chamber and a rupture cavity therebetween.

5. The system of claim 4, further comprising:

a rupture member having a first side exposed to the rupture cavity and a second side exposed to the wellbore, the rupture member configured to prevent fluid communication between the rupture cavity and the wellbore when a pressure differential between the rupture cavity and the wellbore is less than a predetermined threshold value.

6. The system of claim 5, wherein, when the pressure differential is greater than or equal to the predetermined value, the rupture member is configured to provide fluid communication between the annulus of the wellbore and the rupture cavity, and the third piston moves axially in the uphole direction and contacts the first piston.

7. The system of claim 4, further comprising:

a rupture member having a first side exposed to the rupture cavity and a second side exposed to a source of variable pressure, the rupture member configured to prevent fluid communication between the rupture cavity and the source of variable pressure when a pressure differential between the rupture cavity and the source of variable pressure is less than a predetermined threshold value.

8. The system of claim 7, wherein the source of variable pressure is an annulus of a wellbore.

9. The system of claim 8, wherein the system is coupled to a drill string and is moveable into the wellbore with the drill string, and, as the system is moved deeper into the wellbore, a hydrostatic pressure in the annulus increases, thereby increasing the pressure differential between the rupture cavity and the source of variable pressure.

10. The system of claim 7, wherein, when the pressure differential is greater than or equal to the predetermined value, the rupture member is configured to provide fluid communication between the source of variable pressure and the rupture cavity, and the third piston moves axially in the uphole direction and contacts the first piston.

11. The system of claim 10, wherein, upon contact, the first piston is configured to move axially in the uphole direction causing the damping fluid to flow through the at least one longitudinal groove, the at least one longitudinal groove restricting the flow of the damping fluid across the piston, whereby a velocity of the first piston is decreased.

12. The system of claim 11, wherein the first piston moves axially in the uphole direction and activates the downhole tool.

* * * * *